US005848392A

United States Patent [19]

Shudo

[11] Patent Number: 5,848,392

[45] Date of Patent: Dec. 8, 1998

[54] AUDIO SIGNAL PROCESSING CIRCUIT FOR CHANGING THE PITCH OF RECORDED SPEECH

[75] Inventor: Katsuyuki Shudo, Yokosuka, Japan

[73] Assignee: Victor Company of Japan, Ltd., Yokohama, Japan

[21] Appl. No.: 585,506

[22] Filed: Jan. 16, 1996

[30] Foreign Application Priority Data

Jan. 13, 1995 [JP] Japan ..... 7-021341

[51] Int. Cl.[6] ..... G10L 3/02

[52] U.S. Cl. ..... 704/503; 704/200

[58] Field of Search ..... 395/2.09, 2.1, 395/2.14–2.16, 2.2, 2.24, 2.91, 2.94, 2.21, 2.79; 360/8, 32; 704/201, 205–207, 211, 215, 500, 503, 270, 200

[56] References Cited

U.S. PATENT DOCUMENTS

| | | | |
|---|---|---|---|
| 3,934,094 | 1/1976 | Kobayashi et al. | 395/2.14 |
| 4,586,191 | 4/1986 | Nishimura | 395/2.14 |
| 4,734,795 | 3/1988 | Fukami et al. | 395/2.14 |
| 4,790,014 | 12/1988 | Watanabe et al. | 381/56 |
| 5,131,042 | 7/1992 | Oda | 395/2.16 |

FOREIGN PATENT DOCUMENTS

| | | |
|---|---|---|
| 1137464 | 5/1989 | Japan . |
| 6195866 | 7/1994 | Japan . |
| 7085589 | 3/1995 | Japan . |
| 7114772 | 5/1995 | Japan . |
| 7262687 | 10/1995 | Japan . |

*Primary Examiner*—Kee M. Tung
*Attorney, Agent, or Firm*—Pollock, Vande Sande & Priddy

[57] ABSTRACT

A memory has storage segments at different addresses respectively. A write address signal represents an address which is periodically updated at a first frequency. Samples of an audio signal are sequentially written into storage segments of the memory at addresses represented by the write address signal respectively. A read address signal represents an address which is periodically updated at a second frequency lower than the first frequency. Samples of the audio signal are sequentially read out from storage segments of the memory at addresses represented by the read address signal respectively. After the address represented by the write address signal overtakes the address represented by the read address signal and until the address represented by the read address signal reaches the address represented by the write address signal which occurs when the address represented by the write address signal overtakes the address represented by the read address signal, inhibition is given of writing of samples of the audio signal into storage segments of the memory at addresses different from the address represented by the write address signal which occurs when the address represented by the write address signal overtakes the address represented by the read address signal.

6 Claims, 10 Drawing Sheets

10
INPUT SIGNAL
20
LPF
18
A/D
21
LPF
OUTPUT SIGNAL
19
D/A
17
MEMORY
WAD/RAD
16
SELECTOR
15
FF
Q
D
EQ
14
CMPA
RAD
WAD
E1
12
ADRS COUNT
EN
13
ADRS COUNT
WCK
RCK
S
/WE
/CS
11
CONTROLLER

110
INPUT SIGNAL
120
LPF
121
LPF
OUTPUT SIGNAL
122
DET
118
A/D
119
D/A
117
MEMORY
WAD/RAD
SM
116
SELECTOR
123
INV
/SM
124
AND
125
NOR
/Q
115
FF
Q
Q̄
D
CK
EQ
114
CMPA
126
NAND
WAD
E2
RAD
E3
112
ADRS COUNT
EN
113
ADRS COUNT
EN
WCK
RCK
S
/WE
/CS
111
CONTROLLER

AUDIO SIGNAL PROCESSING CIRCUIT FOR CHANGING THE PITCH OF RECORDED SPEECH

BACKGROUND OF THE INVENTION

1. Field of the Invention

This invention relates to an audio signal processing circuit having a pitch converting function.

2. Description of the Prior Art

General VTR's (video tape recorders) are able to reproduce recorded video information at either a normal speed or a high speed. The high speed is equal to, for example, a given integer times the normal speed.

Some advanced VTR's have head drive devices using electrostrictive actuators or voice coil motors. The head drive device enables a video head to accurately follow video tracks on a magnetic tape even during high-speed playback (high-speed reproduction). Thus, the head drive device enables noise-less high-speed reproduction of recorded video information.

In the case where a recorded audio signal is also reproduced during high-speed playback, the pitch of a reproduced audio signal is higher than the pitch of an original audio signal. When the pitch of the reproduced audio signal is excessively high, speech represented by the reproduced audio signal tends to be incomprehensible.

Japanese published unexamined patent application 6-195866 discloses an audio signal processing circuit having a pitch converting function. In the processing circuit of Japanese application 6-195866, an input audio signal is periodically sampled. The resultant samples of the input audio signal are sequentially written into a memory at a high speed (a short period), and the audio signal samples are read out from the memory at a low speed (a long period) to generate a pitch-down-converted audio signal.

In the processing circuit of Japanese application 6-195866, the input audio signal is divided into equal-length blocks along a time base, and the input audio signal is handled block by block. As previously described, writing samples of the input audio signal into the memory has a short period while reading the input signal samples from the memory has a long period. Thus, for every block, a writing process is completed in a time shorter than the time spent by a reading process. Accordingly, in the processing circuit of Japanese application 6-195866, only a former part of every block of the input audio signal is used as sampled and written information while a latter part thereof is discarded. In some cases, the discard of a latter part of every block of the input audio signal causes incomprehensibleness in speech represented by the corresponding pitch-down-converted audio signal.

SUMMARY OF THE INVENTION

It is an object of this invention to provide an improved audio signal processing circuit.

A first aspect of this invention provides an audio signal processing circuit including a memory having storage segments at different addresses respectively. A first means generates a write address signal representing an address which is periodically updated at a first frequency and a second means sequentially writes samples of an audio signal into storage segments of the memory at addresses represented by the write address signal respectively. A third means generates a read address signal representing an address which is periodically updated at a second frequency lower than the first frequency. A fourth means sequentially reads out samples of the audio signal from storage segments of the memory at addresses represented by the read address signal respectively. A fifth means detects whether or not the address represented by the write address signal overtakes the address represented by the read address signal and a sixth means for detecting whether or not the address represented by the read address signal reaches the address represented by the write address signal which occurs when the address represented by the write address signal overtakes the address represented by the read address signal. A seventh means which, after the fifth means detects that the address represented by the write address signal overtakes the address represented by the read address signal, and until the sixth means detects that the address represented by the read address signal reaches the address represented by the write address signal (which occurs when the address represented by the write address signal overtakes the address represented by the read address signal), continuously inhibits writing of samples of the audio signal into storage segments of the memory at addresses different from the address represented by the write address signal when the address represented by the write address signal overtakes the address represented by the read address signal.

A second aspect of this invention is based on the first aspect thereof, and provides an audio signal processing circuit further comprising eighth means for detecting whether or not the audio signal is in a silent state. A ninth means responsive to the eighth means for, in cases where the audio signal is in the silent state, inhibits writing of samples of the audio signal into storage segments of the memory at addresses different from the address represented by the write address signal which occurs when the audio signal falls into the silent state. A tenth means detects whether or not the audio signal moves out of the silent state. A eleventh means responsive to the tenth means restarts writing of samples of the audio signal into storage segments of the memory when the audio signal moves out of the silent state. A twelfth means detects whether or not the address represented by the read address signal reaches the address represented by the write address signal which occurs when the audio signal falls into the silent state. A thirteenth means means, after the twelfth means detects that the address represented by the read address signal reaches the address represented by the write address signal which occurs when the audio signal falls into the silent state and until the tenth means detects that the audio signal moves out of the silent state, continuously inhibits reading-out of samples of the audio signal from storage segments of the memory at addresses different from the address represented by the read address signal when the address represented by the read address signal reaches the address represented by the write address signal.

A third aspect of this invention provides an audio signal processing circuit comprising a memory having storage segments at different addresses respectively. A first means generates a write address signal representing an address which is periodically updated at a first frequency. A second means for sequentially writes samples of an audio signal into storage segments of the memory at addresses represented by the write address signal respectively. A third means generates a read address signal representing an address which is periodically updated at a second frequency lower than the first frequency. A fourth means sequentially reads out samples of the audio signal from storage segments of the memory at addresses represented by the read address signal respectively. A fifth means detects whether or not the audio signal is in a silent state. A sixth means responsive to the fifth means, in cases where the audio signal is in the silent state, inhibits the writing of samples of the audio signal into storage segments of the memory at addresses different from the address represented by the write address signal when the audio signal falls into the silent state. A seventh means detects whether or not the audio signal moves out of the silent state. An eighth means responsive to the seventh means restarts writing of samples of the audio signal into storage segments of the memory when the audio signal moves out of the silent state. A ninth means for detecting whether or not the address represented by the read address signal reaches the address represented by the write address signal which occurs when the audio signal falls into the silent state. A tenth means, after the ninth means detects that the address represented by the read address signal reaches the address represented by the write address signal when the audio signal falls into the silent state, and until the seventh means detects that the audio signal moves out of the silent state, continuously inhibits reading-out of samples of the audio signal from storage segments of the memory at addresses different from the address represented by the read address signal, when the address represented by the read address signal reaches the address represented by the write address signal.

A fourth aspect of this invention provides an audio signal processing circuit comprising a memory having storage segments at different addresses respectively. A first means generates a write address signal representing an address which is periodically updated at a first frequency. A second means sequentially writing samples of an audio signal into storage segments of the memory at addresses represented by the write address signal. A third means generates a read address signal representing an address which is periodically updated at a second frequency lower than the first frequency. A fourth means sequentially reads out samples of the audio signal from storage segments of the memory at addresses represented by the read address signal. A fifth means detects whether or not the address represented by the write address signal overtakes the address represented by the read address signal. A sixth means stops updating the address represented by the write address signal when the fifth means detects that the address represented by the write address signal overtakes the address represented by the read address signal. A seventh means detects whether or not the address represented by the read address signal overtakes the address represented by the write address signal. An eighth means inhibits updating the address represented by the write address signal until the seventh means detects that the address represented by the read address signal overtakes the address represented by the write address signal.

A fifth aspect of this invention is based on the fourth aspect thereof, and provides an audio signal processing circuit further comprising ninth means for detecting whether or not the audio signal is in a silent state. A tenth means suspends updating of the address represented by the write address signal when the ninth means detects that the audio signal is in the silent state. An eleventh means enables updating of the address represented by the write address signal when the ninth means detects that the audio signal is not in the silent state. A twelfth means stops updating of the address represented by the read address signal when the seventh means detects that the address represented by the read address signal overtakes the address represented by the write address signal in cases where the tenth means continuously suspends updating of the address represented by the write address signal. A thirteenth means continuously stops the updating of the address represented by the read address signal until the ninth means detects that the audio signal is not in the silent state.

A sixth aspect of this invention provides an audio signal processing circuit comprising a memory having storage segments at different addresses respectively; first means generates a write address signal representing an address which is periodically updated at a first frequency. A second means sequentially writes samples of an audio signal into storage segments of the memory at addresses represented by the write address signal. A third means generates a read address signal representing an address which is periodically updated at a second frequency lower than the first frequency; fourth means sequentially reads out samples of the audio signal from storage segments of the memory at addresses represented by the read address signal respectively. A fifth means detects whether or not the audio signal is in a silent state. A sixth means suspends updating the address represented by the write address signal when the fifth means detects that the audio signal is in the silent state. A seventh means for enabling updating of the address represented by the write address signal when the fifth means detects that the audio signal is not in the silent state. An eighth means detects whether or not the address represented by the read address signal overtakes the address represented by the write address signal. A ninth means stops updating of the address represented by the read address signal when the eighth means detects that the address represented by the read address signal overtakes the address represented by the write address signal when the sixth means continuously suspends updating of the address represented by the write address signal. A tenth means continues to stop updating of the address represented by the read address signal until the fifth means detects that the audio signal is not in the silent state.

A seventh aspect of this invention provides an audio signal processing circuit comprising a memory. A first means sequentially and periodically writes temporally-spaced samples of a first time portion of an audio signal into a first portion of the memory at a first period. A second means sequentially and periodically writes temporally-spaced samples of a second time portion following the first time portion, of the audio signal into a second portion of the memory which differs from the first memory portion at the first period. A third means sequentially and periodically reads out the samples of the first and second time portions of the audio signal from the first and the second portions of the memory at a second period longer than the first period. A fourth means sequentially and periodically writes temporally-spaced samples of a third time portion of the audio signal into the first portion of the memory at the first period after the third means reads out the samples of the first time portion of the audio signal from the first portion of the memory. A fifth means sequentially and periodically reads out the samples of the third time portion of the audio signal from the first portion of the memory at the second period.

DESCRIPTION OF THE PREFERRED EMBODIMENTS

A prior-art audio signal processing circuit will be described hereinafter for a better understanding of this invention. The prior-art audio signal processing circuit handles an input audio signal which results from triple-speed playback. Here, "triple-speed" means a speed equal to three times a normal speed. The input audio signal is divided into equal-length blocks along a time base. Every block of the input audio signal corresponds to a time interval of 4 seconds with respect to an original audio signal which is recorded on a magnetic tape at the normal speed.

Figure 1:
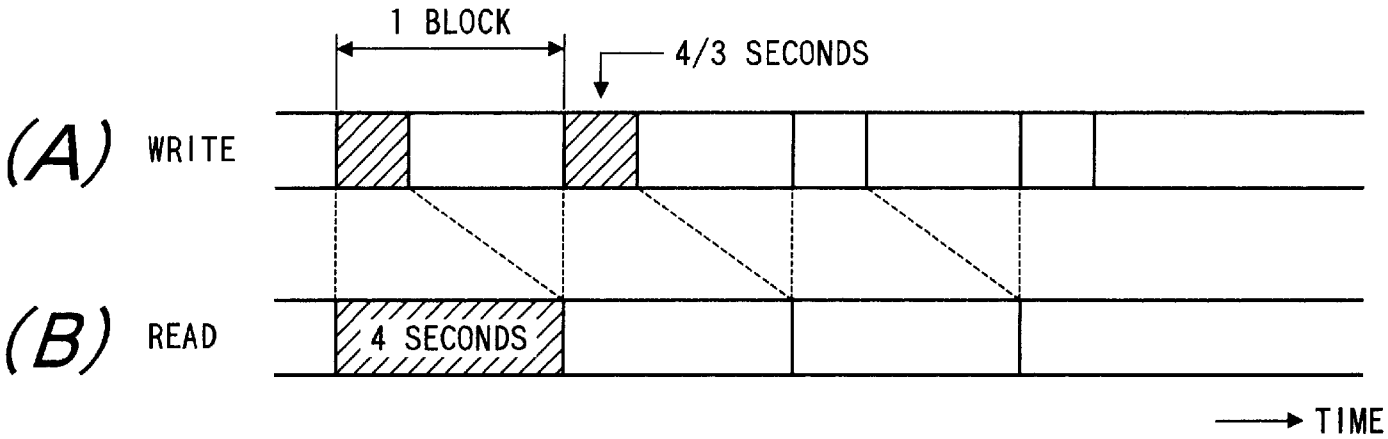
FIG. 1 PRIOR ART
FIG. 1 is a time-domain diagram of a data writing process and a data reading process in a prior-art audio signal processing circuit.

With reference to the portion (A) of FIG. 1, in the prior-art audio signal processing circuit, a former part of every block of the input video signal is periodically sampled and written into a memory. The former part of every block of the input video signal is denoted by each of hatched regions in the portion (A) of FIG. 1. The former part of every block of the input video signal corresponds to a time interval of ⅔ seconds with respect to the original audio signal.

With reference to the portion (B) of FIG. 1, in the prior-art audio signal processing circuit, the input video signal samples corresponding to the former part of every block are sequentially read out from the memory at a long period to form a 4-second time segment of a pitch-down-converted audio signal.

In the prior-art audio signal processing circuit, writing the signal samples into the memory and reading the signal samples from the memory are executed on a time division basis. Thus, every moment of accessing the memory for a wiring purpose differs from every moment of accessing the memory for a reading purpose.

Figure 2:
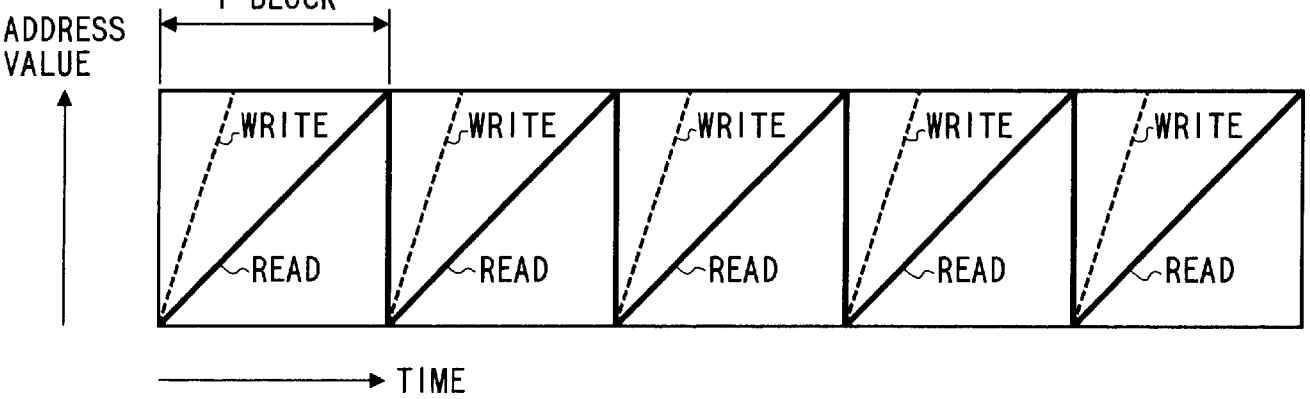
FIG. 2 PRIOR ART
FIG. 2 is a time-domain diagram of a write address value and a read address value in the prior-art audio signal processing circuit.

FIG. 2 shows time-domain variations in values (addresses) represented by a read address signal and a write address signal applied to the memory in the prior-art audio signal processing circuit. As shown in FIG. 2, at a head of every block, the write address value and the read address value start to increase from equal minimum values. The increase in the write address value and the increase in the read address value have a higher rate and a lower rate respectively. The increasing rate of the write address value is equal to three times the increasing rate of the read address value. The write address value reaches a maximum value when a time interval of ⅔ seconds elapses since the start of every block. Thus, for every block, a writing process Is completed in ⅔ seconds from the block head. On the other hand, the read address signal reaches a maximum value when a time interval of 4 seconds elapses since the start of every block.

In the prior-art audio signal processing circuit, the writing of the signal samples into the memory and the reading of the signal samples from the memory at respective different rates generates a conversion-resultant audio signal having a pitch equal to one third of the pitch of the input audio signal.

As understood from the previous description, in the prior-art audio signal processing circuit, only a former part of every block of the input audio signal is used as sampled and written information while a latter part thereof is discarded. As a result, speech represented by the pitch-down-converted audio signal is periodically interrupted. Thus, in some cases, speech represented by the pitch-down-converted audio signal is incomprehensible.

First Embodiment

Figure 3:
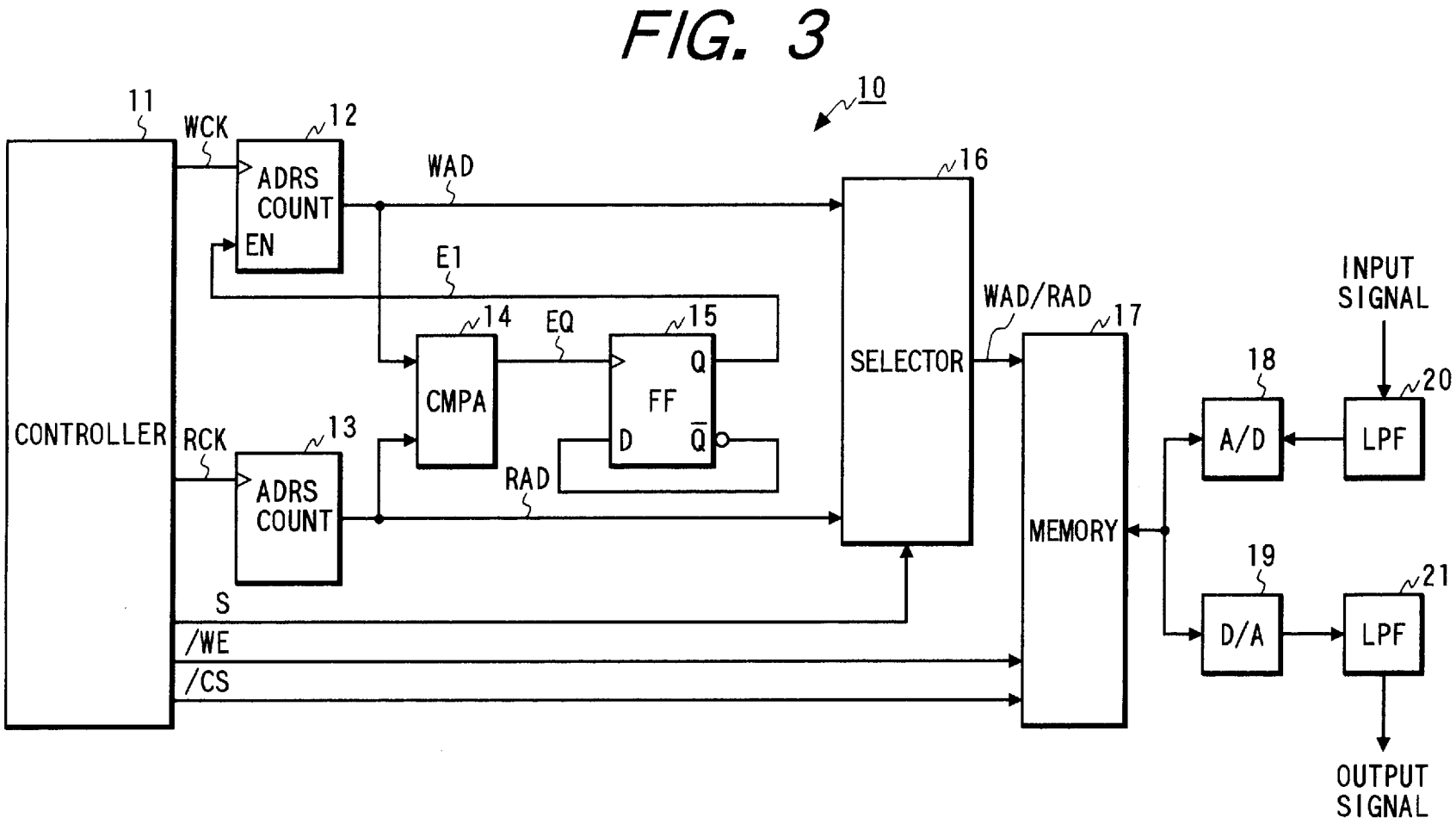
FIG. 3 is a block diagram of an audio signal processing circuit according to a first embodiment of this invention.

With reference to FIG. 3, an audio signal processing circuit 10 includes a controller 11, a memory write address counter 12, a memory read address counter 13, a comparator 14, a D flip-flop 15, a selector 16, a memory 17, an analog-to-digital (A/D) converter 18, a digital-to-analog (D/A) converter 19, and low pass filters 20 and 21.

An input analog audio signal is fed to the A/D converter 18 via the low pass filter 20 before being converted into a corresponding digital audio signal by the A/D converter 18. The input analog audio signal is generated in a VTR (not shown) during high-speed playback, for example, triple-speed playback. Here, "triple-speed" means a speed equal to three times a normal speed. The A/D converter 18 periodically samples the input analog audio signal in response to a fixed-frequency sampling clock signal, and converts every sample of the input analog audio signal into a corresponding digital version (a digital audio signal segment). The A/D converter 18 sequentially outputs the digital audio signal segments to the memory 17.

The digital audio signal segments outputted from the A/D converter 18 are sequentially written into storage segments of the memory 17 respectively which are designated by a write address signal WAD. The digital audio signal segments are sequentially read out from storage segments of the memory 17 respectively which are designated by a read address signal RAD. The frequency of reading the digital audio signal segments from the memory 17 is lower than the frequency of writing the digital audio signal segments into the memory 17. In other words, the period of reading the digital audio signal segments from the memory 17 is longer than the period of writing the digital audio signal segments into the memory 17. This frequency (period) setting results in pitch-down-conversion of speech represented by the digital audio signal segments. The readout digital audio signal segments are sequentially fed to the D/A converter 19 before being converted into analog versions (analog audio signal segments) thereby respectively. The analog audio signal segments are sequentially fed from the D/A converter 19 to the low pass filter 21. The analog audio signal segments are processed by the low pass filter 21 into an output analog audio signal (a pitch-down-converted audio signal or a conversion-resultant audio signal). The output analog audio signal is transmitted from the low pass filter 21. The output analog audio signal has a pitch lower than the pitch of the input analog audio signal. For example, the pitch of the output analog audio signal is equal to one third of the pitch of the input analog audio signal.

Writing the digital audio signal segments into the memory 17 and reading the digital audio signal segments from the memory 17 are executed on a time division basis. Thus, every moment of accessing the memory 17 for a writing purpose differs from every moment of accessing the memory 17 for a reading purpose.

Figure 4:
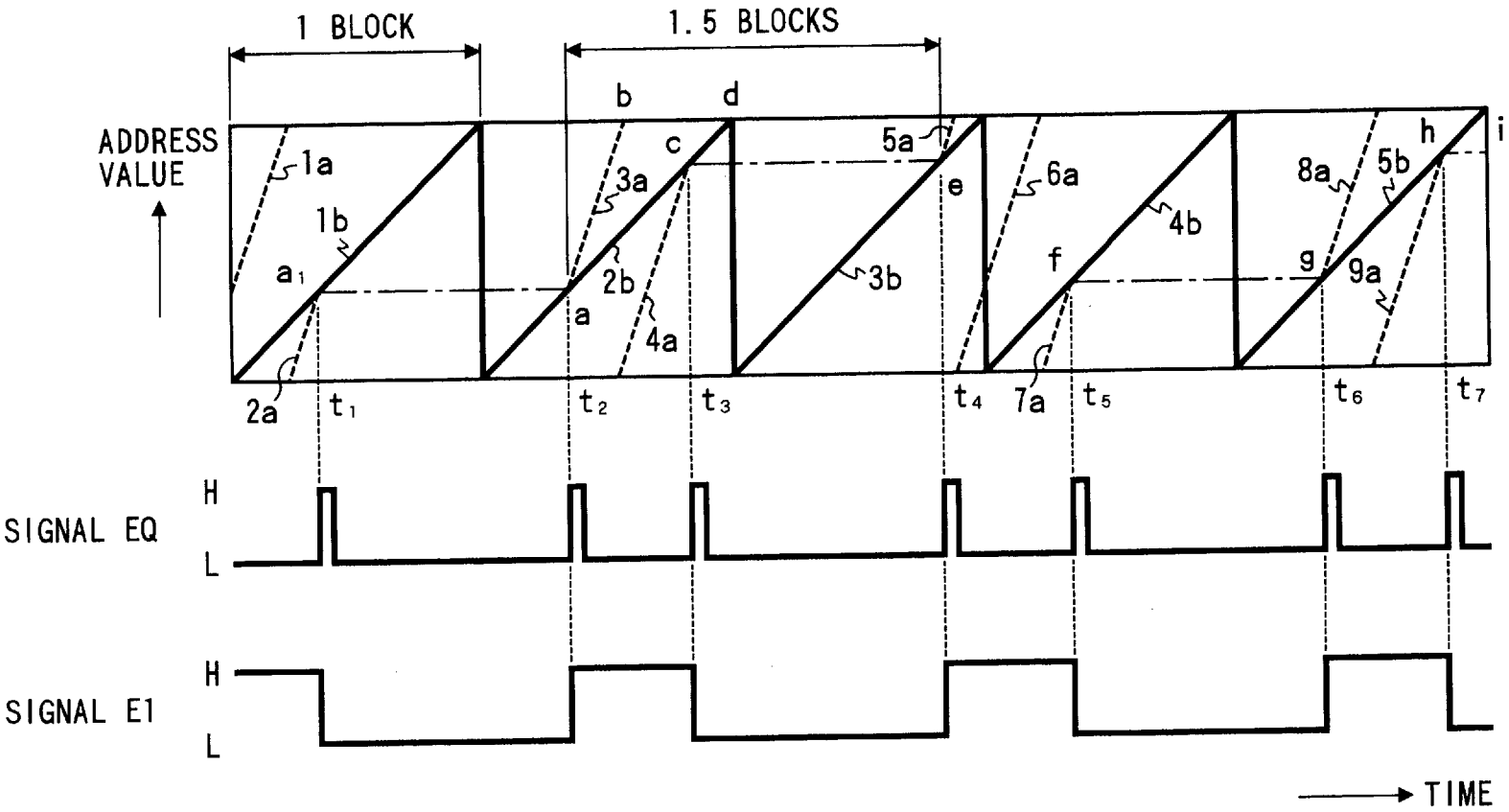
FIG. 4 is a time-domain diagram of a write address value, a read address value, an equality signal EQ, and an enable/disable signal E1 in the audio signal processing circuit of FIG. 3.

FIG. 4 shows an example of time-domain variations in values (addresses) represented by the read address signal RAD and the write address signal WAD applied to the memory 17. With reference to FIG. 4, the write address value is updated along the straight line 1*a,* the straight line 2*a,* the straight line between the point "a1" and the point "a", the straight line 3*a,* the straight line 4*a,* the straight line between the point "c" and the point "e", the straight line 5*a,* the straight line 6*a,* the straight line 7*a,* the straight line between the point "f" and the point "g", the straight line 8*a,* the straight line 9*a,* and the straight line between the point "h" and the point "i". As shown in FIG. 4, the execution of updating of the write address value is intermittent at a period of 1.5 blocks which corresponds to, for example, 6 seconds. The inclined straight lines 1*a*–9*a* have a same given slope.

The controller 11 outputs an address selection signal S (see FIG. 5) to the selector 16. The controller 11 outputs a write/read control signal /CS (see FIG. 5) and a write control signal /WE (see FIG. 5) to the memory 17. When the address selection signal S, the write/read control signal /CS, and the write control signal /WE are in their low-level states ("L" states), the digital audio signal segments outputted from the A/D converter 18 are sequentially written into storage segments of-the memory 17 respectively which are designated by the write address signal WAD. The frequency (the speed) of writing the digital audio signal segments into the memory 17 is equal to, for example, three times the frequency (the speed) of reading the digital audio signal segments from the memory 17.

With reference to FIG. 4, the read address value is updated along the straight line 1*b,* the straight line 2*b,* the straight line 3*b,* the straight line 4*b,* and the straight line 5*b.* As shown in FIG. 4, the updating of the read address value is continuous. The inclined straight lines 1*b*–5*b* have a same given slope equal to, for example, one third of the slope of the inclined straight lines 1*a*–9*a* related to the write address value.

When the address selection signal S, the write/read control signal /CS, and the write control signal /WE are in a high-level state (an "H" state), a low-level state (an "L" state), and a high-level state (an "H" state) respectively, the digital audio signal segments are sequentially read out from storage segments of the memory 17 respectively which are designated by the read address signal RAD.

As previously described, the updating of the write address value is intermittent while the updating of the read address value is continuous. The slope (the rate) updating of the write address value is equal to, for example, three times the slope updating of the read address value. With reference to FIG. 4, the updating of the write address value stops when the write address value overtakes the read address value (the moments t1, t3, t5, and t7). Then, the updating of the write address value remains suspended until the read address value overtakes the write address value (the moments t2, t4, and t6). On the other hand, the updating of the read address value is continuous.

With reference to FIG. 4, the write address value starts to be updated from the point "a" and then continues to be updated until reaching the point "c" via the point "b". During the time interval between the moments t2 and t3 corresponding to the points "a" and "c", the write address value increases from the point "a" to the highest point "b" one by one and then drops to the lowest point. Subsequently, the write address value increases from the lowest point to the point "c" one by one via the point corresponding to the point "a". Accordingly, write address values appearing in a given end part of the time interval between the moments t2 and t3 are equal to those appearing in a given start part of the time interval between the moments t2 and t3. The updating of the write address value stops when the write address value reaches the point "c" (the moment t3). Then, the updating of the write address value remains suspended and continues to be equal to the value corresponding to the point "c" for a given length of time which terminates at the moment t4. During the time interval between the moments t2 and t3 corresponding to the points "a" and "c" respectively, the digital audio signal segments outputted from the A/D converter 18 are sequentially written into the memory 17. In this case, a given number of storage segments in the memory 17 are used twice while the other storage segments therein are used only once. The digital audio signal segments, which have been written during the time interval between the moments t2 and t3, are sequentially read out from the memory 17 during the time interval between the moments t2 and t4. During the time interval between the moments t2 and t4, the read address value increases from the point "a" to the highest point "d" one by one via the point "c" and then drops to the lowest point. Subsequently, the read address value increases from the lowest point to the point "e" one by one via the point corresponding to the point "a". Accordingly, read address values appearing in a given end part of the time interval between the moments t2 and t4 are equal to those appearing in a given start part of the time interval between the moments t2 and t4. At the moment t4, the read address value reaches the point "e" which corresponds to the point "c" of the write address value. At the moment t4, the write address value restarts to be updated.

For example, 2-second time segments of the input analog audio signal which are temporally spaced at equal intervals are used while the other time segments thereof are discarded. Specifically, a set of digital samples of each 2-second time segment of the input analog audio signal is written into the memory 17. A set of digital samples of each 2-second time segment of the input analog audio signal is read out from the memory 17 before being made into a 6-second time segment of the output analog audio signal. Under certain conditions of the input analog audio signal, the use of 2-second time segments of the input analog audio signal is advantageous over the use of ⅔-second time segments of the input analog audio signal in the comprehensibility of speech represented by the output analog audio signal As previously described, a given number of storage segments in the memory 17 are used twice during the handling of each 2-second time segment of the input analog audio signal. This makes it possible that a smaller capacity of the memory 17 suffices.

Figure 5:
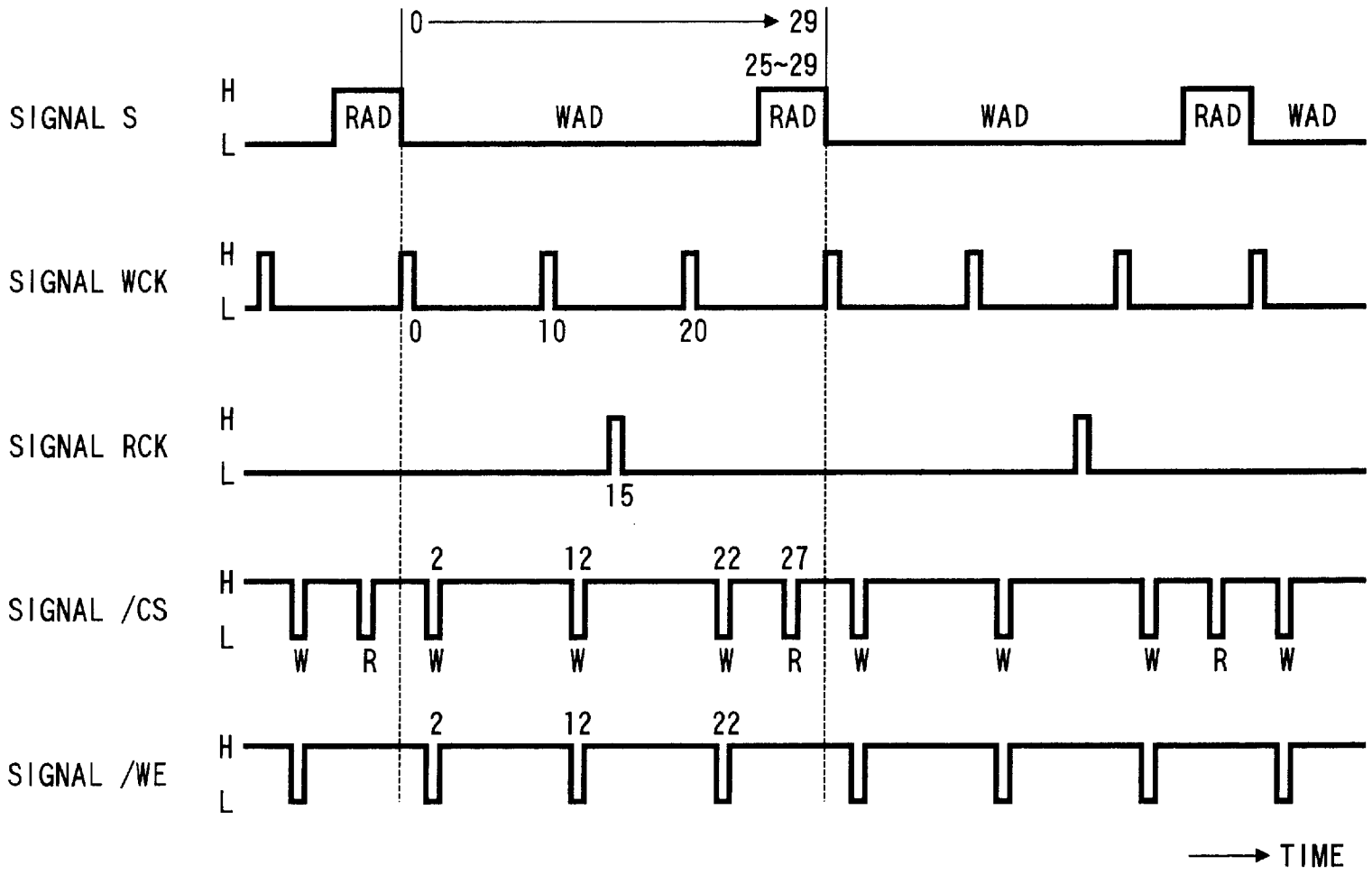
FIG. 5 is a time-domain diagram of various signals in the audio signal processing circuit of FIG. 3.

The controller 11 includes a combination of a generator for producing a basic clock signal, a counter, frequency dividers, and logic gates. Alternatively, the controller 11 may include a programmable digital signal processor or a similar device. The controller 11 is designed to generate the address selection signal S (see FIG. 5), the write/read control signal /CS (see FIG. 5), the write control signal /WE (see FIG. 5), a write clock signal WCK (see FIG. 5), and a read clock signal RCK (see FIG. 5). As previously described, the controller 11 outputs the address selection signal S to the selector 16. The controller 11 outputs the write/read control signal /CS and the write control signal /WE to the memory 17. The controller 11 outputs the write clock signal WCK and the read clock signal RCK to the memory write address counter 12 and the memory read address counter 13 respectively. The address selection signal S, the write/read control signal /CS, the write control signal /WE, the write clock signal WCK, and the read clock signal RCK periodically change between high-level states ("H" states) and low-level states ("L" states) as shown in FIG. 5.

As previously described, the frequency (the speed) of writing the digital audio signal segments into the memory 17 is higher than the frequency (the speed) of reading the digital audio signal segments from the memory 17. To this end, the frequency of the write clock signal WCK is equal to, for example, three times the frequency of the read clock signal RCK. In other words, the period of the write clock signal WCK is equal to, for example, one third of the period of the read clock signal RCK.

Normally, the memory write address counter 12 generates the write address signal WAD in response to the write clock signal WCK by counting pulses in the write clock signal WCK. The value (the address) represented by the write address signal WAD is incremented by one or returned from the maximum to the minimum in response to each pulse in the write clock signal WCK. The memory read address counter 13 generates the read address signal RAD in response to the read clock signal RCK by counting pulses in the read clock signal RCK. The value (the address) represented by the read address signal RAD is incremented by one or returned from the maximum to the minimum in response to each pulse in the read clock signal RCK.

The memory write address counter 12 outputs the write address signal WAD to the comparator 14 and the selector 16. The memory read address counter 13 outputs the read address signal RAD to the comparator 14 and the selector 16. The device 14 compares the values (the addresses) represented by the write address signal WAD and the read address signal RAD. The comparator 14 generates an equality signal EQ (see FIG. 4) in response to the write address signal WAD and the read address signal RAD. As shown in FIG. 4, the equality signal EQ assumes a high-level state (an "H" state) when the values (the addresses) represented by the write address signal WAD and the read address signal RAD become equal. The equality signal EQ is in a low-level state (an "L" state) when the values (the addresses) represented by the write address signal WAD and the read address signal RAD are different from each other. With reference to FIG. 4, the equality signal EQ changes to the high-level state at the moments t1, t2, t3, t4, t5, t6, and t7. The comparator 14 outputs the equality signal EQ to the clock input terminal of the D flip-flop 15. The D flip-flop 15 serves as a frequency divider which halves the frequency of the equality signal EQ. The D flip-flop 15 generates an enable/disable signal E1 (see FIG. 4) from the equality signal EQ by the frequency halving process. As shown in FIG. 4, the enable/disable signal E1 changes between a high-level state (an "H" state) and a low-level state (an "L" state) in response to every positive-going edge (every L-to-H edge) in the equality signal EQ. The D flip-flop 15 outputs the enable/disable signal E1 to an enable input of the memory write address counter 12.

The selector 16 chooses one out of the write address signal WAD and the read address signal RAD in response to the address selection signal S, and transmits the selected address signal to the memory 17. Specifically, as shown in FIG. 5, the selector 16 chooses the write address signal WAD and transmits the write address signal WAD to the memory 17 when the address selection signal S is in the low-level state (the "L" state). The selector 16 chooses the read address signal RAD and transmits the read address signal RAD to the memory 17 when the address selection signal S is in the high-level state (the "H" state).

The memory write address counter 12 is enabled and disabled in response to the enable/disable signal E1 fed from the D flip-flop 15. Specifically, the memory write address counter 12 remains enabled when the enable/disable signal E1 is in the high-level state (the "H" state). The memory write address counter 12 remains disabled when the enable/disable signal E1 is in the low-level state (the "L" state). In the case where the memory write address counter 12 remains enabled, the value (the address) represented by the write address signal WAD is incremented by one or returned from the maximum to the minimum in response to each pulse in the write clock signal WCK. In the case where the memory write address counter 12 remains disabled, the value (the address) represented by the write address signal WAD continues to be equal to the value (the address) which occurs immediately before the memory write address counter 12 is disabled. When the memory write address counter 12 is returned from the disabled state to the enabled state, the value (the address) represented by the write address signal WAD starts to be updated from the value (the address) which occurs immediately before the memory write address counter 12 is disabled.

With reference to FIG. 4, the memory write address counter 12 remains enabled during the time interval between the moments t2 and t3, the time interval between t4 and t5, and the time interval between the moments t6 and t7. The memory write address counter 12 remains disabled during the time interval between the moments t1 and t2, the time interval between t3 and t4, and the time interval between the moments t5 and t6.

Specifically, at the moment t1, the write address value overtakes the read address value so that the equality signal EQ outputted from the comparator 14 changes to the high-level state. The D flip-flop 15 causes the enable/disable signal E1 to fall into the low level state in response to the low-to-high change of the equality signal EQ. The low-level enable/disable signal E1 disables the write address counter 12. Thus, at the moment t1, the updating of the write address value is stopped. The updating of the write address value continues to be suspended until the read address value overtakes the write address value (the moment t2). At the moment t2, the read address value overtakes the write address value so that the equality signal EQ changes to the high-level state again. The D flip-flop 15 causes the enable/disable signal E1 to return to the high level state in response to the low-to-high change of the equality signal EQ. The high-level enable/disable signal E1 enables the write address counter 12. Thus, at the moment t2, the updating of the write address value is restarted.

As shown in FIG. 5, three negative pulses occur in the write control signal /WE during every period for which the address selection signal S remains in the low-level state (the "L" state). Also, three negative pulses occur in the write/read control signal /CS during every period for which the address selection signal S remains in the low-level state (the "L" state). The three negative pulses in the write control signal /WE are synchronized with the three negative pulses in the write/read control signal /CS respectively. Three digital samples of the input analog audio signal are sequentially written into the memory 17 in response to the three negative pulses in the write control signal /WE and the three negative pulses in the write/read control signal /CS during every period for which the address selection signal S remains in the low-level state (the "L" state). The negative pulses in the write control signal /WE are temporally spaced at equal intervals. Similarly, the negative pulses in the write/read control signal /CS are temporally spaced at equal intervals.

As shown in FIG. 5, the write clock signal WCK has a train of positive pulses which are temporally spaced at equal intervals. The intervals between the positive pulses in the write clock signal WCK are equal to the intervals between the negative pulses in the write control signal /WE. The negative pulses in the write control signal /WE are temporally offset from the positive pulses in the write clock signal WCK.

As shown in FIG. 5, one negative pulse occurs in the write/read control signal /CS during every period for which the address selection signal S remains in the high-level state (the "H" state). One digital sample of the input analog audio signal is read out from the memory 17 in response to the negative pulse in the write/read control signal /CS during every period for which the address selection signal S remains in the high-level state (the "H" state).

As shown in FIG. 5, the read clock signal RCK has a train of positive pulses which are temporally spaced at equal intervals. The intervals between the positive pulses in the read clock signal RCK are equal to the intervals between the negative pulses in the write/read control signal /CS which occur when the address selection signal S is in the high-level state (the "H" state). The negative pulses in the write/read control signal /CS, which occur when the address selection signal S is in the high-level state (the "H" state), are temporally offset from the positive pulses in the read clock signal RCK.

Figure 12:
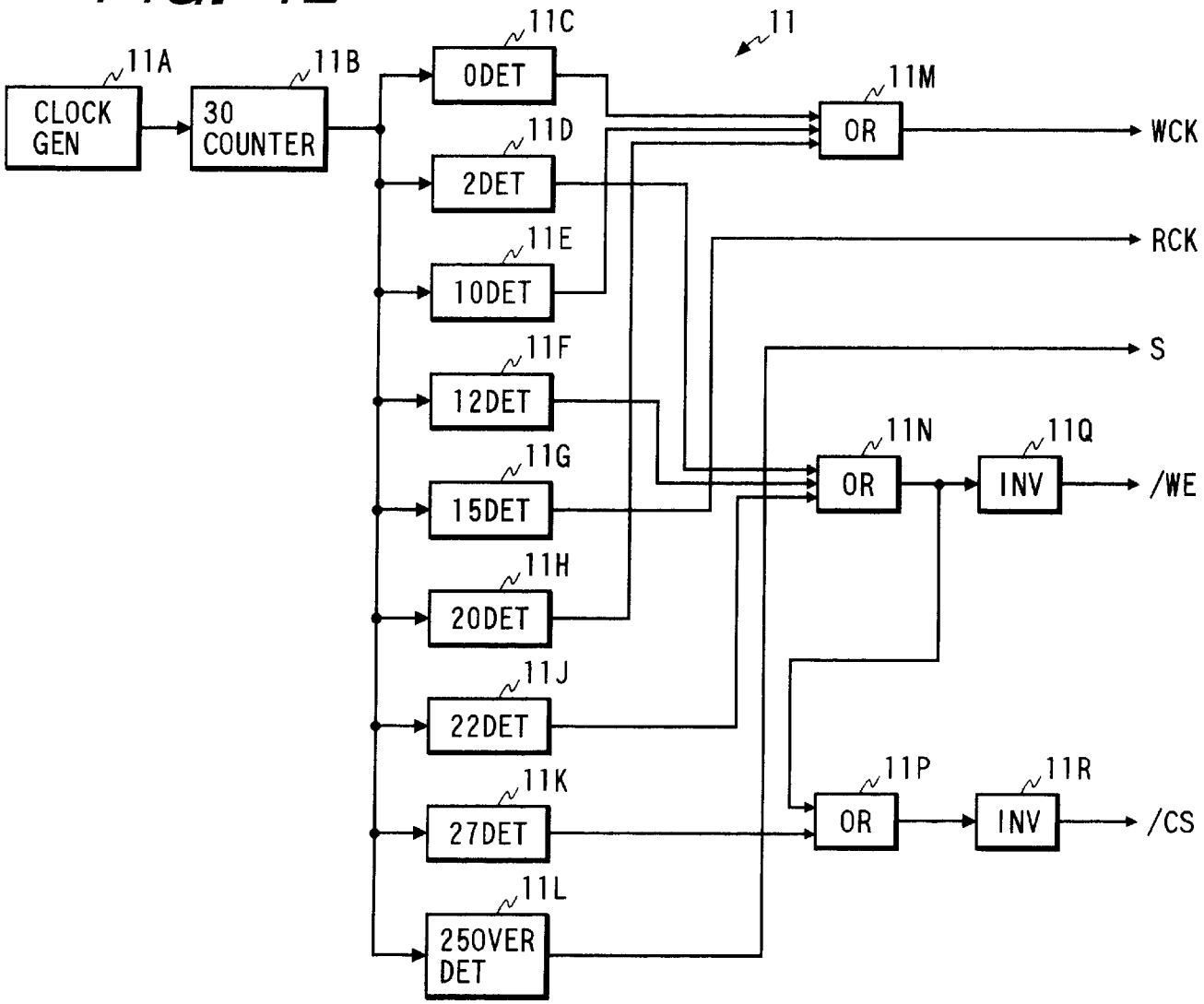
FIG. 12 is a block diagram of a controller in FIG. 3.

With reference to FIG. 12, the controller 11 includes a clock signal generator 11A, a counter 11B, signal detectors 11C, 11D, 11E, 11F, 11G, 11H, 11J, 11K, 11L, OR gates 11M, 11N, 11P, and inverters 11Q and 11R. The output terminal of the clock signal generator 11A is connected to the input terminal of the counter 11B. The output terminal of the counter 11B is connected to the input terminals of the signal detectors 11C, 11D, 11E, 11F, 11G, 11H, 11J, 11K, and 11L. The output terminal of the signal detector 11C is connected to a first input terminal of the OR gate 11M. The output terminal of the signal detector 11D is connected to a first input terminal of the OR gate 11N. The output terminal of the signal detector 11E is connected to a second input terminal of the OR gate 11M. The output terminal of the signal detector 11F is connected to a second input terminal of the OR gate 11N. The signal detector 11G outputs the read clock signal RCK. The output terminal of the signal detector 11H is connected to a third input terminal of the OR gate 11M. The output terminal of the signal detector 11J is connected to a third input terminal of the OR gate 11N. The output terminal of the signal detector 11K is connected to a first input terminal of the OR gate 11P. The signal detector 11L outputs the address selection signal S. The OR gate 11M outputs the write clock signal WCK. The output terminal of the OR gate 11N is connected to the input terminal of the inverter 11Q. The output terminal of the OR gate 11N is also connected to a second input terminal of the OR gate 11P. The inverter 11Q outputs the write control signal /WE. The output terminal of the OR gate 11P is connected to the input terminal of the inverter 11R. The inverter 11R outputs the write/read control signal /CS.

The clock signal generator 11A produces a fixed-frequency pulse signal referred to as a basic clock signal. The basic clock signal is fed from the clock signal generator 11A to the counter 11B. The device 11B counts pulses in the basic clock signal, generating and outputting a count-resultant signal indicating the number of counted pulses. The state of the count-resultant signal sequentially and cyclically changes as "0", "1", "2", "3", . . . , "27", "28", "29". The output signal of the counter 11B is fed to the signal detectors 11C, 11D, 11E, 11F, 11G, 11H, 11J, 11K, and 11L. The signal detectors 11C, 11D, 11E, 11F, 11G, 11H, 11J, and 11K sense "0", "2", "10", "12", "15", "20", "22", and "27" represented by the output signal of the counter 11B respectively. The signal detector 11L senses "25", "26", "27", "28", and "29" represented by the output signal of the counter 11B. Specifically, the signal detector 11C outputs a high-level signal when the output signal of the counter 11B is "0". Otherwise, the signal detector 11C outputs a low-level signal. The signal detector 11D outputs a high-level signal when the output signal of the counter 11B is "2". Otherwise, the signal detector 11D outputs a low-level signal. The signal detector 11E outputs a high-level signal when the output signal of the counter 11B is "10". Otherwise, the signal detector 11E outputs a low-level signal. The signal detector 11F outputs a high-level signal when the output signal of the counter 11B is "12". Otherwise, the signal detector 11F outputs a low-level signal. The signal detector 11G outputs a high-level signal when the output signal of the counter 11B is "15". Otherwise, the signal detector 11G outputs a low-level signal. The signal detector 11H outputs a high-level signal when the output signal of the counter 11B is "20". Otherwise, the signal detector 11H outputs a low-level signal. The signal detector 11J outputs a high-level signal when the output signal of the counter 11B is "22". Otherwise, the signal detector 11J outputs a low-level signal. The signal detector 11K outputs a high-level signal when the output signal of the counter 11B is "27". Otherwise, the signal detector 11K outputs a low-level signal. The signal detector 11L outputs a high-level signal when the output signal of the counter 11B is one of "25", "26", "27", "28", and "29". Otherwise, the signal detector 11L outputs a low-level signal.

The OR gate 11M receives the output signals of the signal detectors 11C, 11E, and 11H, executing an OR operation and thereby generating the write clock signal WCK (see FIG. 5). As previously described, the signal detector 11G outputs the read clock signal RCK (see FIG. 5). The signal detector 11L outputs the address selection signal S (see FIG. 5). The OR gate 11N receives the output signals of the signal detectors 11D, 11F, and 11J, executing an OR operation. The output signal of the OR gate 11N is applied to the inverter 11Q and the OR gate 11P. The device 11Q inverts the output signal of the OR gate 11N, thereby generating the write control signal /WE (see FIG. 5). The OR gate 11P receives the output signals of the OR gate 11N and the signal detector 11K, executing an OR operation. The output signal of the OR gate 11P is applied to the inverter 11R. The device 11R inverts the output signal of the OR gate 11P, thereby generating the write/read control signal /CS (see FIG. 5).

As described previously, the memory write address counter 12 is enabled and disabled in response to whether or not the read address value and the write address value are equal to each other. The memory write address counter 12 may be enabled and disabled in response to whether or not the difference between the read address value and the write address value is equal to a given value.

As understood from the previous description, each of the memory write address counter 12 and the memory read address counter 13 executes an up-count process. Each of the memory write address counter 12 and the memory read address counter 13 may execute a down-count process.

Second Embodiment

A second embodiment of this invention is similar to the embodiment of FIGS. 3–5 except for design changes indicated hereinafter. In the second embodiment, an input analog audio signal fed to an A/D converter 18 (see FIG. 3) via a low pass filter 20 (see FIG. 3) is generated in a VTR (not shown) during quintuple-speed playback. Here, "quintuple-speed" means a speed equal to five times a normal speed. In the second embodiment, the period of a write clock signal WCK (see FIGS. 3 and 5) is equal to one fifth of the period of a read clock signal RCK (see FIGS. 3 and 5).

Figure 6:
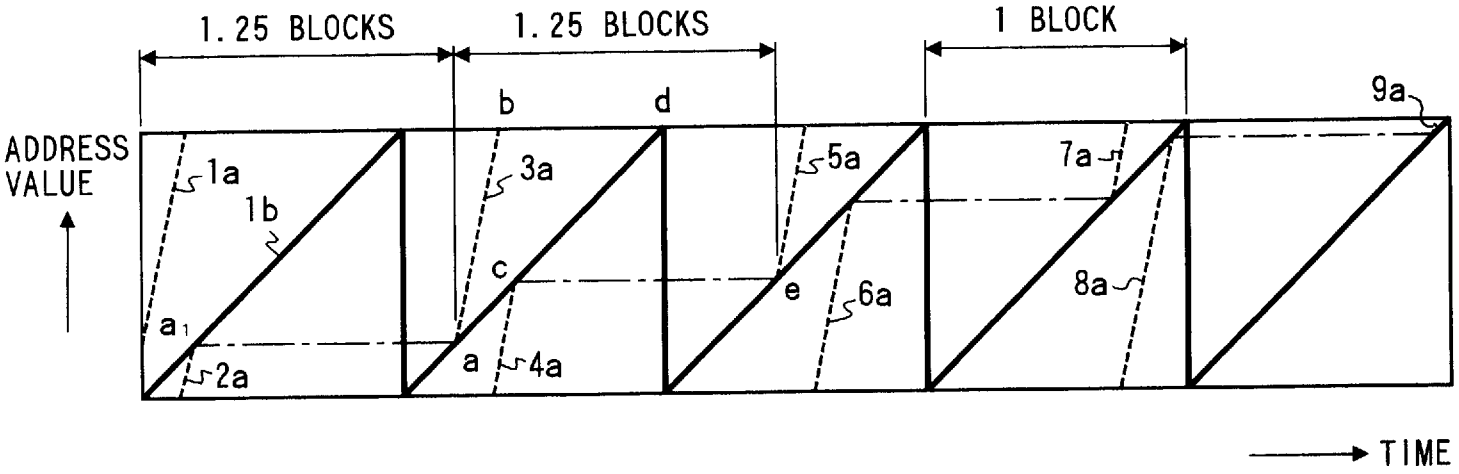
FIG. 6 is a time-domain diagram of a write address value and a read address value in an audio signal processing circuit according to a second embodiment of this invention.

With reference to FIG. 6, in the second embodiment, the updating of a write address value is intermittent at a period of 1.25 blocks which corresponds to, for example, 5 seconds. For example, 1-second time segments of the input analog audio signal which are temporally spaced at equal intervals are used while the other time segments thereof are discarded. Specifically, a set of digital samples of each 1-second time segment of the input analog audio signal is written into a memory 17 (see FIG. 3). A set of digital samples of each 1-second time segment of the input analog audio signal is read out from the memory 17 before being made into a 5-second time segment of an output analog audio signal.

It should be noted that a controller 11 (see FIG. 3) may be designed to handle an input analog audio signal resulting from quintuple-speed playback as well as an input analog audio signal resulting from triple-speed playback.

Third Embodiment

A third embodiment of this invention is basically similar to the embodiment of FIGS. 3–5 except for additional arrangements which will be described later.

Figure 7:
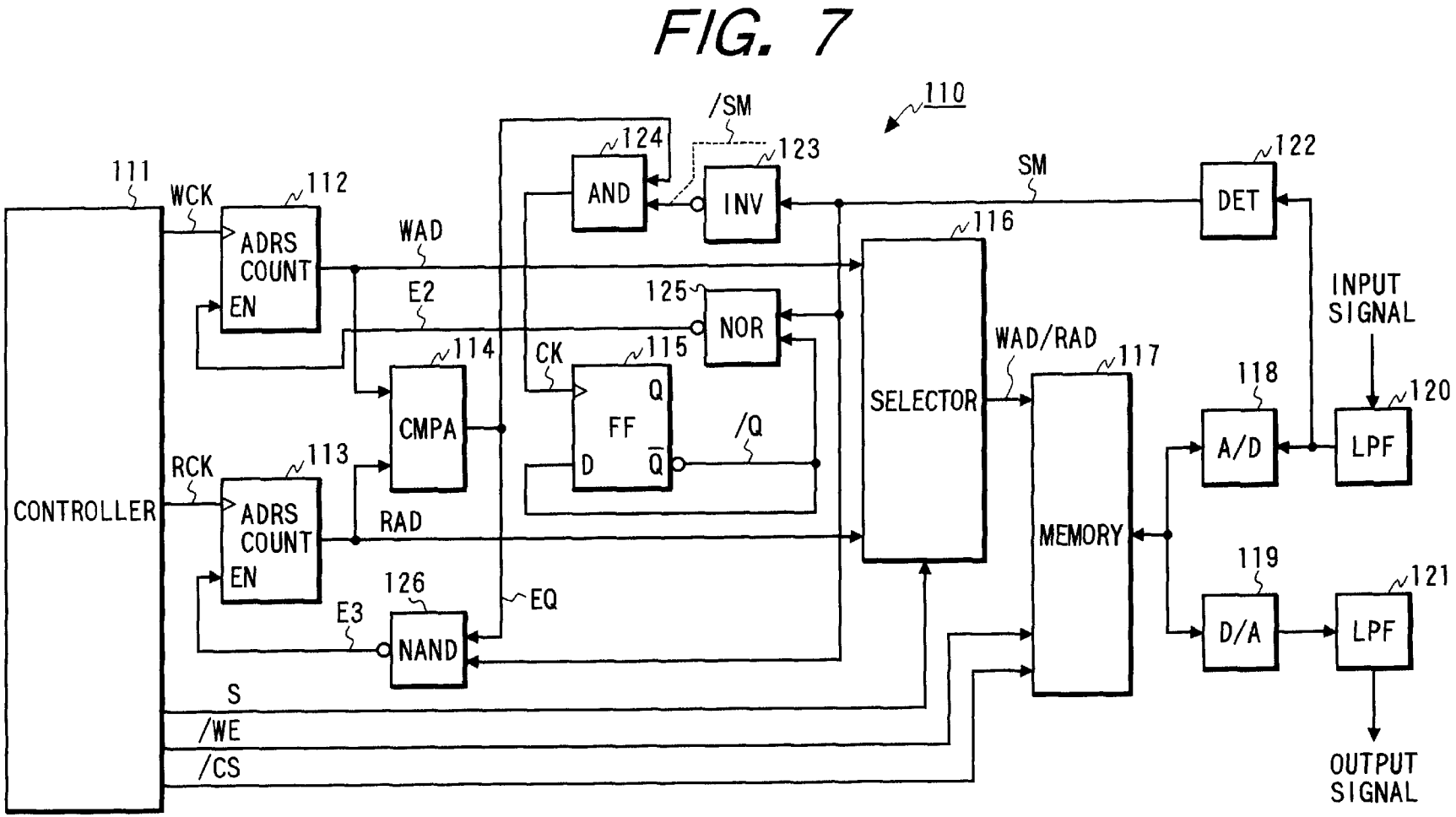
FIG. 7 is a block diagram of an audio signal processing circuit according to a third embodiment of this invention.

With reference to FIG. 7, an audio signal processing circuit 110 includes a controller 111, a memory write address counter 112, a memory read address counter 113, a comparator 114, a D flip-flop 115, a selector 116, a memory 117, an analog-to-digital (A/D) converter 118, a digital-to-analog (D/A) converter 119, and low pass filters 120 and 121. The audio signal processing circuit 110 also includes a silence detector 122, an inverter 123, an AND gate 124, a NOR gate 125, and a NAND gate 126.

An input analog audio signal is fed to the A/D converter 118 via the low pass filter 120 before being converted into a corresponding digital audio signal by the A/D converter 118. The input analog audio signal is generated in a VTR (not shown) during high-speed playback, for example, triple-speed playback. Here, "triple-speed" means a speed equal to three times a normal speed. The A/D converter 118 periodically samples the input analog audio signal in response to a fixed-frequency sampling clock signal, and converts every sample of the input analog audio signal into a corresponding digital version (a digital audio signal segment). The A/D converter 118 sequentially outputs the digital audio signal segments to the memory 117.

The digital audio signal segments outputted from the A/D converter 118 are sequentially written into storage segments of the memory 117 respectively which are designated by a write address signal WAD. The digital audio signal segments are sequentially read out from storage segments of the memory 117 respectively which are designated by a read address signal RAD. The frequency of reading the digital audio signal segments from the memory 117 is lower than the frequency of writing the digital audio signal segments into the memory 117. In other words, the period of reading the digital audio signal segments from the memory 117 is longer than the period of writing the digital audio signal segments into the memory 117. This frequency (period) setting results in pitch-down-conversion of speech represented by the digital audio signal segments. The readout digital audio signal segments are sequentially fed to the D/A converter 119 before being converted into analog versions (analog audio signal segments) thereby respectively. The analog audio signal segments are sequentially fed from the D/A converter 119 to the low pass filter 121. The analog audio signal segments are processed by the low pass filter 121 into an output analog audio signal (a pitch-down-converted audio signal or a conversion-resultant audio signal). The output analog audio signal is transmitted from the low pass filter 121. The output analog audio signal has a pitch lower than the pitch of the input analog audio signal. For example, the pitch of the output analog audio signal is equal to one third of the pitch of the input analog audio signal.

Writing the digital audio signal segments into the memory 117 and reading the digital audio signal segments from the memory 117 are executed on a time division basis. Thus, every moment of accessing the memory 117 for a wiring purpose differs from every moment of accessing the memory 117 for a reading purpose.

Figure 8:
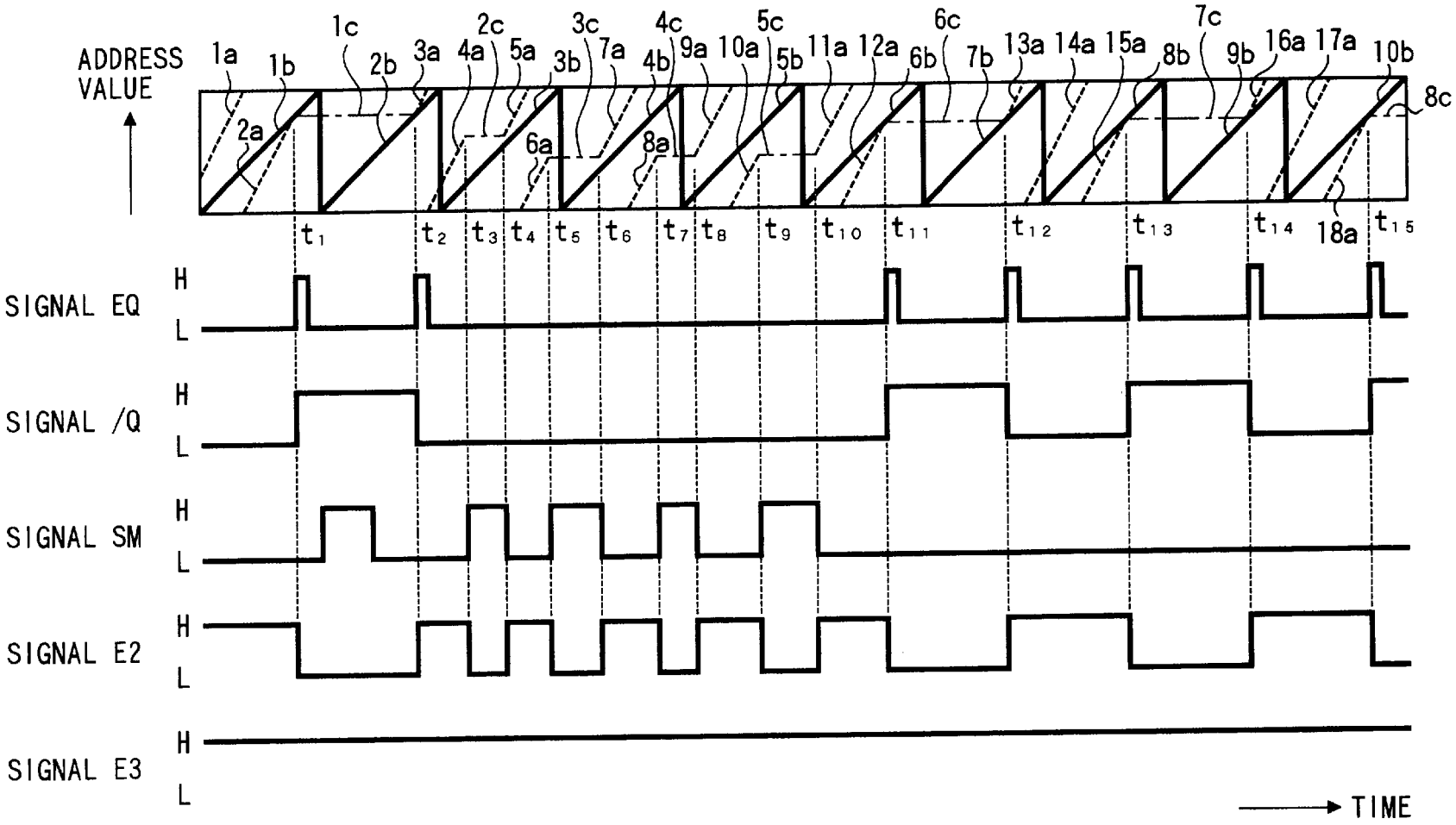
FIG. 8 is a time-domain diagram of a write address value, a read address value, and various signals in the audio signal processing circuit of FIG. 7.

The silence detector 122 receives the input analog audio signal from the low pass filter 120, and serves to detect whether or not the input analog audio signal is in a silent state. The silence detector 122 outputs a binary signal SM representing whether or not the input analog audio signal is in the silent state. Specifically, the output signal SM of the silence detector 122 is in a high-level state (an "H" state) when the input analog audio signal is in the silent state. The output signal SM of the silence detector 122 is in a low-level state (an "L" state) when the input analog audio signal is not in the silent state, that is, when the input analog audio signal is in an unsilent state. The output signal SM of the silence detector 122 changes in time domain such as shown in FIG. 8. The output signal SM of the silence detector 122 is applied to the inverter 123, being inverted thereby into a signal /SM. The output signal SM of the silence detector 122 is also applied to first input terminals of the NOR gate 125 and the NAND gate 126. The inverter 123 outputs the signal /SM to a first input terminal of the AND gate 124.

The controller 111 outputs an address selection signal S to the selector 116. The controller 111 outputs a write/read control signal /CS and a write control signal /WE to the memory 117. When the address selection signal S, the write/read control signal /CS, and the write control signal /WE are in their low-level states ("L" states), the digital audio signal segments outputted from the A/D converter 118 are sequentially written into storage segments of the memory 117 respectively which are designated by the write address signal WAD. The frequency (the speed) of writing the digital audio signal segments into the memory 117 is equal to, for example, three times the frequency (the speed) of reading the digital audio signal segments from the memory 117.

When the address selection signal S, the write/read control signal /CS, and the write control signal /WE are in a high-level state (an "H" state), a low-level state (an "L" state), and a high-level state (an "H" state) respectively, the digital audio signal segments are sequentially read out from storage segments of the memory 117 respectively which are designated by the read address signal RAD.

The controller 111 includes a combination of a generator for producing a basic clock signal, a counter, frequency dividers, and logic gates. Alternatively, the controller 111 may include a programmable digital signal processor or a similar device. The controller 111 is designed to generate the address selection signal S, the write/read control signal /CS, the write control signal /WE, a write clock signal WCK, and a read clock signal RCK. As previously described, the controller 111 outputs the address selection signal S to the selector 116. The controller 111 outputs the write/read control signal /CS and the write control signal /WE to the memory 117. The controller 111 outputs the write clock signal WCK and the read clock signal RCK to the memory write address counter 112 and the memory read address counter 113 respectively. The address selection signal S, the write/read control signal /CS, the write control signal /WE, the write clock signal WCK, and the read clock signal RCK periodically change between high-level states ("H" states) and low-level states ("L" states).

As previously described, the frequency (the speed) of writing the digital audio signal segments into the memory 117 is higher than the frequency (the speed) of reading the digital audio signal segments from the memory 117. To this end, the frequency of the write clock signal WCK is equal to, for example, three times the frequency of the read clock signal RCK. In other words, the period of the write clock signal WCK is equal to, for example, one third of the period of the read clock signal RCK.

Normally, the memory write address counter 112 generates the write address signal WAD in response to the write clock signal WCK by counting pulses in the write clock signal WCK. The value (the address) represented by the write address signal WAD is incremented by one or returned from the maximum to the minimum in response to each pulse in the write clock signal WCK. Normally, the memory read address counter 113 generates the read address signal RAD in response to the read clock signal RCK by counting pulses in the read clock signal RCK. The value (the address) represented by the read address signal RAD is incremented by one or returned from the maximum to the minimum in response to each pulse in the read clock signal RCK.

The memory write address counter 112 outputs the write address signal WAD to the comparator 114 and the selector 116. The memory read address counter 113 outputs the read address signal RAD to the comparator 114 and the selector 116. The device 114 compares the values (the addresses) represented by the write address signal WAD and the read address signal RAD. The comparator 114 generates an equality signal EQ (see FIG. 8) in response to the write address signal WAD and the read address signal RAD. As shown in FIG. 8, normally, the equality signal EQ assumes a high-level state (an "H" state) when the values (the addresses) represented by the write address signal WAD and the read address signal RAD become equal. The equality signal EQ is in a low-level state (an "L" state) when the values (the addresses) represented by the write address signal WAD and the read address signal RAD are different from each other. With reference to FIG. 8, the equality signal EQ changes to the high-level state at the moments t1, t2, t11, t12, t13, t14, and t15. The comparator 114 outputs the equality signal EQ to second input terminals of the AND gate 124 and the NAND gate 126.

The AND gate 124 outputs a high-level signal CK when the input analog audio signal is not in the silent state and there occurs an agreement between the values (the addresses) represented by the write address signal WAD and the read address signal RAD. Otherwise, the AND gate 124 outputs a low-level signal CK. The output signal CK of the AND gate 124 is applied to the clock input terminal of the D flip-flop 115. The D flip-flop 115 serves as a frequency divider which halves the frequency of the output signal CK of the AND gate 124 or the frequency of the equality signal EQ. The D flip-flop 115 generates and outputs a signal /Q (see FIG. 8) in response to the output signal CK of the AND gate 124 by the frequency halving process. The output signal /Q of the D flip-flop 115 is applied to a second input terminal of the NOR gate 125.

The device 125 executes logic NOR operation between the output signal SM of the silence detector 122 and the output signal /Q of the D flip-flop 115, thereby generating and outputting an enable/disable signal E2 (see FIG. 8) in response to the signals SM and /Q. The NOR gate 125 outputs the enable/disable signal E2 to an enable input terminal of the memory write address counter 112.

The memory write address counter 112 is enabled and disabled in response to the enable/disable signal E2 fed from the NOR gate 125. Specifically, the memory write address counter 112 remains enabled when the enable/disable signal E2 is in the high-level state (the "H" state). The memory write address counter 112 remains disabled when the enable/disable signal E2 is in the low-level state (the "L" state). In the case where the memory write address counter 112 remains enabled, the value (the address) represented by the write address signal WAD is incremented by one or returned from the maximum to the minimum in response to each pulse in the write clock signal WCK. In the case where the memory write address counter 112 remains disabled, the value (the address) represented by the write address signal WAD continues to be equal to the value (the address) which occurs immediately before the memory write address counter 112 is disabled. When the memory write address counter 112 is returned from the disabled state to the enabled state, the value (the address) represented by the write address signal WAD starts to be updated from the value (the address) which occurs immediately before the memory write address counter 112 is disabled.

The device 126 executes logic NAND operation between the output signal SM of the silence detector 122 and the equality signal EQ from the comparator 114, thereby generating and outputting an enable/disable signal E3 (see FIG. 8) in response to the signals SM and EQ. The NAND gate 126 outputs the enable/disable signal E3 to an enable input terminal of the memory read address counter 113.

The memory read address counter 113 is enabled and disabled in response to the enable/disable signal E3 fed from the NAND gate 126. Specifically, the memory read address counter 113 remains enabled when the enable/disable signal E3 is in the high-level state (the "H" state). The memory read address counter 113 remains disabled when the enable/disable signal E3 is in the low-level state (the "L" state). In the case where the memory read address counter 113 remains enabled, the value (the address) represented by the read address signal RAD is incremented by one or returned from the maximum to the minimum in response to each pulse in the read clock signal RCK. In the case where the memory read address counter 113 remains disabled, the value (the address) represented by the read address signal RAD continues to be equal to the value (the address) which occurs immediately before the memory read address counter 113 is disabled. When the memory read address counter 113 is returned from the disabled state to the enabled state, the value (the address) represented by the read address signal RAD starts to be updated from the value (the address) which occurs immediately before the memory read address counter 113 is disabled.

The selector 116 chooses one out of the write address signal WAD and the read address signal RAD in response to the address selection signal S, and transmits the selected address signal to the memory 117. Specifically, the selector 116 chooses the write address signal WAD and transmits the write address signal WAD to the memory 117 when the address selection signal S is in the low-level state (the "L" state). The selector 116 chooses the read address signal RAD and transmits the read address signal RAD to the memory 117 when the address selection signal S is in the high-level state (the "H" state).

An upper portion of FIG. 8 shows a first example of time-domain variations in values (addresses) represented by the read address signal RAD and the write address signal WAD applied to the memory 117. With reference to FIG. 8, the write address value is updated along the straight line 1*a*, the straight line 2*a*, the straight line 1*c*, the straight line 3*a*, the straight line 4*a*, the straight line 2*c*, the straight line 5*a*, the straight line 6*a*, the straight line 3*c*, the straight line 7*a*, the straight line 8*a*, the straight line 4*c*, the straight line 9*a*, the straight line 10*a*, the straight line 5*c*, the straight line 11*a*, the straight line 12*a*, the straight line 6*c*, the straight line 13*a*, the straight line 14*a*, the straight line 15*a*, the straight line 7*c*, the straight line 16*a*, the straight line 17*a*, the straight line 18*a*, and the straight line 8*c*. As shown in FIG. 8, the execution of updating of the write address value is intermittent. The inclined straight lines 1*a*–18*a* have a same given slope.

With reference to FIG. 8, the read address value is updated along the straight line 1*b*, the straight line 2*b*, the straight line 3*b*, the straight line 4*b*, the straight line 5*b*, the straight line 6*b*, the straight line 7*b*, the straight line 8*b*, the straight line 9*b*, and the straight line 10*b*. Under the conditions of FIG. 8, the execution of updating of the read address value is continuous. The inclined straight lines 1*b*–10*b* have a same given slope equal to, for example, one third of the slope of the inclined straight lines 1*a*–18*a* related to the write address value.

As previously described, under the conditions of FIG. 8, the of updating of the write address value is intermittent while the updating of the read address value is continuous. The slope (the rate) of updating of the write address value is equal to, for example, three times the slope of updating of the read address value. With reference to FIG. 8, the updating of the write address value stops when the write address value overtakes the read address value (the moments t1, t11, t13, and t15). Then, the updating of the write address value remains suspended until the read address value overtakes the write address value (the moments t2, t12, and t14). In addition, the updating of the write address value stops when the output signal SM of the silence detector 122 changes to the high-level state (when the input analog audio signal changes to the silent state). Then, the updating of the write address value remains suspended until the output signal SM of the silence detector 122 returns to the low-level state (until the input analog audio signal returns to the unsilent state). Under the conditions of FIG. 8, the execution of updating of the read address value is continuous.

With reference to FIG. 8, the write address value starts to be updated and then continues to be updated along the straight lines 1*a* and 2*a* until overtaking the read address value at the moment t1. The updating of the write address value stops when the write address value overtakes the read address value (the moment t1). Then, the write address value remains constant along the straight line 1*c* until the read address value becomes equal to the write address value at the moment t2. When the read address value becomes equal to the write address value (the moment t2), the write address value restarts to be updated from the value which occurs immediately before the stop of the updating of the write address value. In this way, the write address value is prevented from passing the read address value. Also, the read address value is prevented from passing the write address value. After the moment t2, the write address value continues to be updated along the straight lines 3*a* and 4*a* until the output signal SM of the silence detector 122 changes to the high-level state (the "H" state) at the moment t3, that is, until the input analog audio signal changes to the silent state at the moment t3. The updating of the write address value stops when the output signal SM of the silence detector 122 changes to the high-level state (the moment t3). During the time interval between the moments t3 and t4 for which the output signal SM of the silence detector 122 remains in the high-level state (the "H" state), that is, during the time interval for which the input analog audio signal remains in the silent state, the write address value remains constant along the straight line 2*c*. At the moment t4, the output signal of the silence detector 122 returns to the low-level state (the "L" state), that is, the input analog audio signal returns to the unsilent signal. Thus, at the moment t4, the write address value restarts to be updated from the value which occurs immediately before the stop of the updating of the write address value.

Under the conditions of FIG. 8, at the moment t3, the output signal SM of the silence detector 122 changes to the high-level state (the "H" state). The NOR gate 125 causes the enable/disable signal E2 to fall into the low-level state (the "L" state) in response to the low-to-high change of the output signal SM of the silence detector 122. Thus, at the moment t3, the write address counter 113 is disabled by the low-level enable/disable signal E2 so that the updating of the write address value stops. During the time interval between the moments t3 and t4, the enable/disable signal E2 remains in the low-level state and hence the updating of the write address value continues to be suspended. At the moment t4, the output signal SM of the silence detector 122 changes to the low-level state (the "L" state). Since the output signal /Q of the D flip-flop 115 is in the low-level state (the "L" state) at the moment t4, the NOR gate 125 causes the enable/disable signal E2 to return to the high-level state (the "H" state) in response to the high-to-low change of the output signal SM of the silence detector 122. Thus, at the moment t4, the write address counter 113 is enabled by the high-level enable/disable signal E2 so that the write address value restarts to be updated.

As long as the input analog audio signal is in the unsilent state, the following processes are executed. For example, 2-second time segments of the input analog audio signal which are temporally spaced at equal intervals are used while the other time segments thereof are discarded. Specifically, a set of digital samples of each 2-second time segment of the input analog audio signal is written into the memory 117. A set of digital samples of each 2-second time segment of the input analog audio signal is read out from the memory 117 before being made into a 6-second time segment of the output analog audio signal. Under certain conditions of the input analog audio signal, the use of 2-second time segments of the input analog audio signal is advantageous over the use of ⅔-second time segments of the input analog audio signal in the comprehensibility of speech represented by the output analog audio signal. As in the embodiment of FIGS. 3–5, a given number of storage segments in the memory 117 are used twice during the handling of each 2-second time segment of the input analog audio signal. This makes it possible that a smaller capacity of the memory 117 suffices.

The input analog audio signal which is in the silent state is also discarded. In other words, the memory 117 is prevented from storing digital samples of the input analog audio signal which is in the silent state. Thus, it is possible to use a larger percentage of the input analog audio signal which is in the unsilent state.

Figure 9:
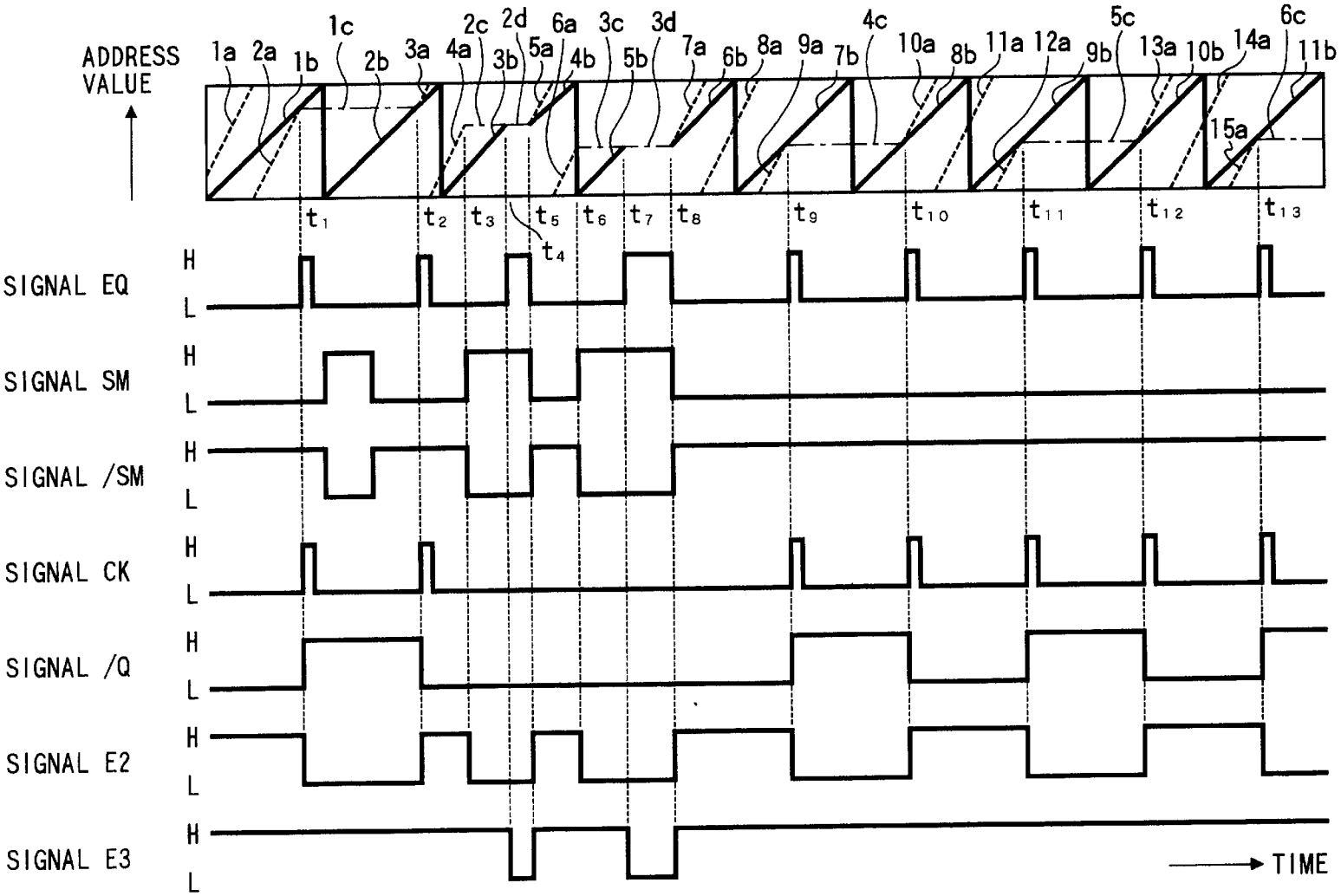
FIG. 9 is another time-domain diagram of the write address value, the read address value, and various signals in the audio signal processing circuit of FIG. 7.

An upper portion of FIG. 9 shows a second example of time-domain variations in the values (the addresses) represented by the read address signal RAD and the write address signal WAD applied to the memory 117. With reference to FIG. 9, the write address value is updated along the straight line 1*a*, the straight line 2*a*, the straight line 1*c*, the straight line 3*a*, the straight line 4*a*, the straight line 2*c*, the straight line 2*d*, the straight line 5*a*, the straight line 6*a*, the straight line 3*c*, the straight line 3*d*, the straight line 7*a*, the straight line 8*a*, the straight line 9*a*, the straight line 4*c*, the straight line 10*a*, the straight line 11*a*, the straight line 12*a*, the straight line 5*c*, the straight line 13*a*, the straight line 14*a*, the straight line 15*a*, and the straight line 6*c*. As shown in FIG. 9, the execution of updating of the write address value is intermittent. The inclined straight lines 1*a*–15*a* have a same given slope.

With reference to FIG. 9, the read address value is updated along the straight line 1*b*, the straight line 2*b*, the straight line 3*b*, the straight line 2*d*, the straight line 4*b*, the straight line 5*b*, the straight line 3*d*, the straight line 6*b*, the straight line 7*b*, the straight line 8*b*, the straight line 9*b*, the straight line 10*b*, and the straight line 11*b*. Under the conditions of FIG. 9, the execution of updating of the read address value is intermittent. The inclined straight lines 1*b*–11*b* have a same given slope equal to, for example, one third of the slope of the inclined straight lines 1*a*–15*a* related to the write address value.

As previously described, under the conditions of FIG. 9, the execution of updating of the write address value is intermittent and the execution of updating of the read address value is also intermittent. The slope (the rate) of updating of the write address value is equal to, for example, three times the slope of updating of the read address value. With reference to FIG. 9, the updating of the write address value stops when the write address value overtakes the read address value (the moments t1, t9, t11, and t13). Then, the updating of the write address value remains suspended until the read address value overtakes the write address value (the moments t2, t10, and t12). In addition, the updating of the write address value stops when the output signal SM of the silence detector 122 changes to the high-level state (when the input analog audio signal changes to the silent state). Then, the updating of the write address value remains suspended until the output signal SM of the silence detector 122 returns to the low-level state (until the input analog audio signal returns to the unsilent state).

During a time interval for which the updating of the write address value remains suspended, the updating of the read address value stops when the read address value becomes equal to the write address value (the moments t4 and t7 in FIG. 9). Then, the updating of the read address value continues to be suspended until the input analog audio signal changes to the unsilent state and hence the updating of the write address value restarts (the moments t5 and t8 in FIG. 9). In other cases, the updating of the read address value is continuous.

With reference to FIG. 9, the write address value starts to be updated and then continues to be updated along the straight lines 1*a* and 2*a* until overtaking the read address value at the moment t1. The updating of the write address value stops when the write address value overtakes the read address value (the moment t1). Then, the write address value remains constant along the straight line 1*c* until the read address value becomes equal to the write address value at the moment t2. When the read address value becomes equal to the write address value (the moment t2), the write address value restarts to be updated from the value which occurs immediately before the stop of the updating of the write address value. In this way, the write address value is prevented from passing the read address value. Also, the read address value is prevented from passing the write address value. After the moment t2, the write address value continues to be updated along the straight lines 3*a* and 4*a* until the output signal SM of the silence detector 122 changes to the high-level state (the "H" state) at the moment t3, that is, until the input analog audio signal changes to the silent state at the moment t3. The updating of the write address value stops when the output signal SM of the silence detector 122 changes to the high-level state (the moment t3). During the time interval between the moments t3 and t5 for which the output signal SM of the silence detector 122 remains in the high-level state (the "H" state), that is, during the time interval for which the input analog audio signal remains in the silent state, the write address value remains constant along the straight line 2*c* and the straight line 2*d*. At the moment t5, the output signal of the silence detector 122 returns to the low-level state (the "L" state), that is, the input analog audio signal returns to the unsilent state. Thus, at the moment t5, the write address value restarts to be updated from the value which occurs immediately before the stop of the updating of the write address value.

Under the conditions of FIG. 9, during the time interval between the moments t3 and t5 for which the write address value remains constant, the read address value becomes equal to the write address value at the moment t4. The updating of the read address value stops when the read address value becomes equal to the write address value (the moment t4). Then, the read address value remains constant along the straight line 2*d* until the moment t5 at which the output signal of the silence detector 122 returns to the low-level state (the "L" state). At the moment t5, the read address value restarts to be updated from the value which occurs immediately before the stop of the updating of the read address value. In this way, the read address value is prevented from passing the write address value. Specifically, at the moment t4, the equality signal EQ changes to the high-level state (the "H" state) since the read address value becomes equal to the write address value. Since the output signal SM of the silence detector 122 is in the high-level state (the "H" state) at the moment t4, the NAND gate 126 causes the enable/disable signal E3 to fall into the low-level state (the "L" state) in response to the low-to-high change of the equality signal EQ. Thus, at the moment t4, the read address counter 112 is disabled by the low-level enable/disable signal E3 so that the updating of the read address value stops. During the time interval between the moments t4 and t5, the enable/disable signal E3 remains in the low-level state and hence the updating of the read address value continues to be suspended. At the moment t5, the output signal SM of the silence detector 122 changes to the low-level state (the "L" state). The NAND gate 126 causes the enable/disable signal E3 to return to the high-level state (the "H" state) in response to the high-to-low change of the output signal SM of the silence detector 122. Thus, at the moment t5, the read address counter 112 is enabled by the high-level enable/disable signal E3 so that the read address value restarts to be updated.

Figure 10:
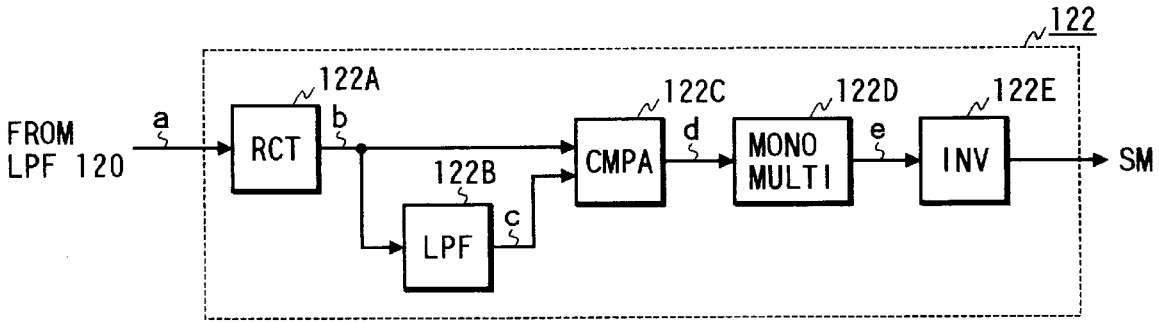
FIG. 10 is a block diagram of a silence detector in FIG. 7.

As shown in FIG. 10, the silence detector 122 includes a rectifier 122A, a low pass filter 122B, a voltage comparator 122C, a mono-stable multivibrator 122D, and an inverter 122E. The input terminal of the rectifier 122A is connected to the output terminal of the low pass filter 120 of FIG. 7. The output terminal of the rectifier 122A is connected to the input terminal of the low pass filter 122B. Also, the output terminal of the rectifier 122A is connected to a first input terminal of the voltage comparator 122C. The output terminal of the low pass filter 122B is connected to a second input terminal of the voltage comparator 122C. The output terminal of the voltage comparator 122C is connected to the input terminal of the mono-stable multivibrator 122D. The output terminal of the mono-stable multivibrator 122D is connected to the input terminal of the inverter 122E. The output terminal of the inverter 122E is connected to the inverter 123, the NOR gate 125, and the NAND gate 126 of FIG. 7.

Figure 11:
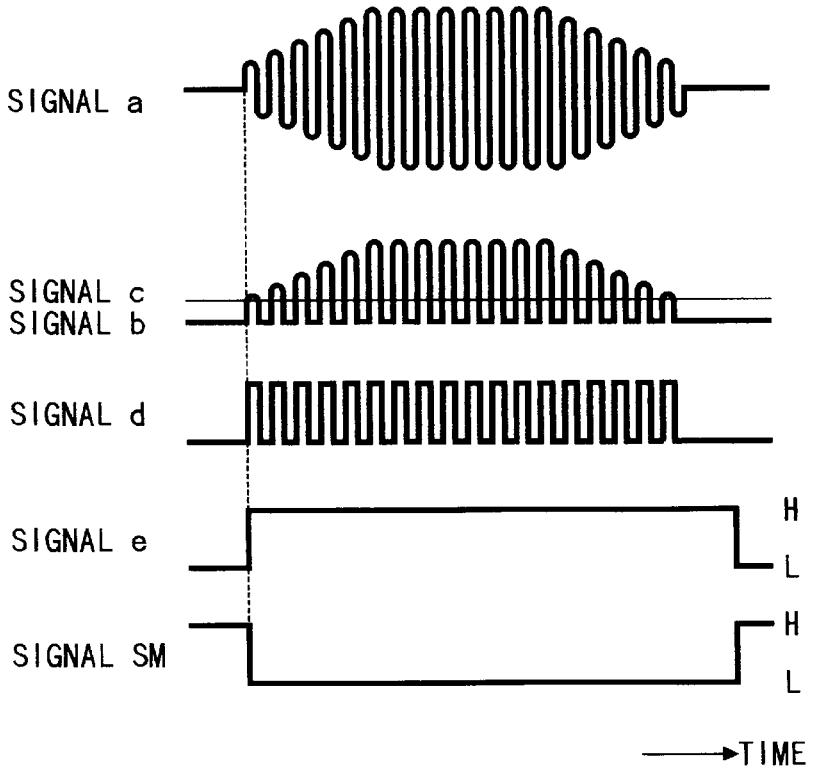
FIG. 11 is a time-domain diagram of various signals in the silence detector of FIG. 10.

The rectifier 122A receives the input analog audio signal "a" from the low pass filter 120 of FIG. 7. The input analog audio signal "a" has a waveform such as shown in FIG. 11. The amplitude of the input analog audio signal "a" decreases to and increases from a substantially null level when the input analog audio signal assumes a silent state and an unsilent state respectively. The device 122A rectifies the input analog audio signal "a" into a signal "b" which has a waveform such as shown in FIG. 11. The rectifier 122A outputs the rectification-resultant signal "b" to the low pass filter 122B and the voltage comparator 122C. The low pass filter 122B has a given large time constant. The low pass filter 122B makes the rectification-resultant signal "b" into a substantially direct-current voltage signal "c" which has a waveform such as shown in FIG. 11. The substantially direct-current voltage signal "c" is fed from the low pass filter 122B to the voltage comparator 122C as a reference level signal. The device 122C compares the voltage of the rectification-resultant signal "b" and the voltage of the reference signal "c". The voltage comparator 122C outputs a signal "d" which depends on the result of the comparison between the voltage of the rectification-resultant signal "b" and the voltage of the reference signal "c". Specifically, the output signal "d" of the voltage comparator 122C assumes a high-level state when the voltage of the rectification-resultant signal "b" is higher than the voltage of the reference signal "c". The output signal "d" of the voltage comparator 122C assumes a low-level state when the voltage of the rectification-resultant signal "b" is not higher than the voltage of the reference signal "c". The output signal "d" of the voltage comparator 122C has a train of pulses such as shown in FIG. 11. The output signal "d" of the voltage comparator 122C is fed to the mono-stable multivibrator 122D. The rising edge of each pulse in the output signal "d" of the voltage comparator 122C triggers the mono-stable multivibrator 122D, causing the mono-stable multivibrator 122D to output a high-level pulse having a given duration. Since the mono-stable multivibrator 122D is re-triggerable, one high-level pulse generally occurs in an output signal "e" of the mono-stable multivibrator 122D while the input analog audio signal remains in the unsilent state. The output signal "e" of the mono-stable multivibrator 122D has a waveform such as shown in FIG. 11. The output signal "e" of the mono-stable multivibrator 122D is fed to the inverter 122E, being inverted thereby into the output signal SM of the silence detector 122. As shown in FIG. 11, the output signal SM of the silence detector 122 is in the high-level state and the low-level state when the input analog audio signal is in the silent state and the unsilent state respectively.

As described previously, the memory write address counter 112 and the memory read address counter 113 are enabled and disabled in response to whether or not the read address value and the write address value are equal to each other. The memory write address counter 112 and the memory read address counter 113 may be enabled and disabled in response to whether or not the difference between the read address value and the write address value is equal to a given value.

The memory write address counter 112 and the memory read address counter 113 may be reset when the enable/disable signal E3 falls into the low-level state (the "L" state).

As understood from the previous description, each of the memory write address counter 112 and the memory read address counter 113 executes an up-count process. Each of the memory write address counter 112 and the memory read address counter 113 may execute a down-count process.

Fourth Embodiment

A fourth embodiment of this invention is similar to the embodiment of FIGS. 7–11 except for design changes indicated hereinafter. In the fourth embodiment, an input analog audio signal fed to an A/D converter 118 (see FIG. 7) via a low pass filter 120 (see FIG. 7) is generated in a VTR (not shown) during quintuple-speed playback. Here, "quintuple-speed" means a speed equal to five times a normal speed. In the fourth embodiment, the period of a write clock signal WCK (see FIG. 7) is equal to one fifth of the period of a read clock signal RCK (see FIG. 7).

It should be noted that a controller 111 (see FIG. 7) may be designed to handle an input analog audio signal resulting from quintuple-speed playback as well as an input analog audio signal resulting from triple-speed playback.

What is claimed is:

1. An audio signal processing circuit comprising:

a memory having storage segments at different addresses respectively;

first means for generating a write address signal representing an address which is periodically updated at a first frequency;

second means for sequentially writing samples of an audio signal into storage segments of the memory at addresses represented by the write address signal;

third means for generating a read address signal representing an address which is periodically updated at a second frequency lower than the first frequency;

fourth means for sequentially reading out samples of the audio signal from storage segments of the memory at addresses represented by the read address signal respectively;

fifth means for detecting whether or not the address represented by the write address signal overtakes the address represented by the read address signal;

sixth means for detecting whether or not the address represented by the read address signal reaches the address represented by the write address signal when the address represented by the write address signal overtakes the address represented by the read address signal; and seventh means for, after the fifth means detects that the address represented by the write address signal overtakes the address represented by the read address signal, and until the sixth means detects that the address represented by the read address signal reaches the address represented by the write address signal when the address represented by the write address signal overtakes the address represented by the read address signal, continuously inhibiting writing of samples of the audio signal into storage segments of the memory at addresses different from the address represented by the write address signal when the address represented by the write address signal overtakes the address represented by the read address signal.

2. The audio signal processing circuit of claim 1, further comprising:

eighth means for detecting whether or not the audio signal is in a silent state;

ninth means responsive to the eighth means for, in cases where the audio signal is in the silent state, inhibiting writing of samples of the audio signal into storage segments of the memory at addresses different from the address represented by the write address signal when the audio signal falls into the silent state;

tenth means for detecting whether or not the audio signal moves out of the silent state;

eleventh means responsive to the tenth means for restarting writing of samples of the audio signal into storage segments of the memory when the audio signal moves out of the silent state;

twelfth means for detecting whether or not the address represented by the read address signal reaches the address represented by the write address signal when the audio signal falls into the silent state; and thirteenth means for, after the twelfth means detects that the address represented by the read address signal reaches the address represented by the write address signal which occurs when the audio signal falls into the silent state and until the tenth means detects that the audio signal moves out of the silent state, continuously inhibiting reading-out of samples of the audio signal from storage segments of the memory at addresses different from the address represented by the read address signal which occurs when the address represented by the read address signal reaches the address represented by the write address signal.

3. An audio signal processing circuit comprising:

a memory having storage segments at different addresses respectively;

fist means for generating a write address signal representing an address which is periodically updated at a first frequency;

second means for sequentially writing samples of an audio signal into storage segments of the memory at addresses represented by the write address signal respectively;

third means for generating a read address signal representing an address which is periodically updated a second frequency lower than the first frequency;

fourth means for sequentially reading out samples of the audio signal from storage segments of the memory at addresses represented by the read address signal respectively;

fifth means for detecting whether or not the audio signal is in a silent sate;

sixth means responsive to the fifth means for, in cases where the audio signal is in the silent state, inhibiting writing of samples of the audio signal into storage segments of the memory at addresses different from the address represented by the write address signal when the audio signal falls into the silent state;

seventh means for detecting whether or not the audio signal moves out of the silent state;

eighth means responsive to the seventh means for restarting writing of samples of the audio signal into storage segments of the memory when the audio signal moves out of the silent state;

ninth means for detecting whether or not the address represented by the read address signal reaches the address represented by the write address signal when the audio signal falls into the silent state; and tenth means for, after the ninth means detects that the address represented by the read address signal reaches the address represented by the write address signal when the audio signal falls into the silent state and until the seventh means detects that the audio signal moves out of the silent state, continuously inhibiting reading-out of samples of the audio signal from storage segments of the memory at addresses different from the address represented by the read address signal when the address represented by the read address signal reaches the address represented by the write address signal.

4. An audio signal processing circuit comprising:

a memory having storage segments at different addresses respectively;

first means for generating a write address signal representing an address which is periodically updated at a first frequency;

second means for sequentially writing samples of an audio signal into storage segments of the memory at addresses represented by the write address signal;

third means for generating a read address signal representing an address which is periodically updated at a second frequency lower than the first frequency;

fourth means for sequentially reading out samples of the audio signal from storage segments of the memory at addresses represented by the read address signal respectively;

fifth means for detecting whether or not the address represented by the write address signal overtakes the address represented by the read address signal;

sixth means for stopping updating of the address represented by the write address signal when the fifth means detects that the address represented by the write address signal overtakes the address represented by the read address signal;

seventh means for detecting whether or not the address represented by the read address signal overtakes the address represented by the write address signal; and eighth means for continuing stopping of updating of the address represented by the write address signal until the seventh means detects that the address represented by the read address signal overtakes the address represented by the write address signal.

5. The audio signal processing circuit of claim 4, further comprising:

ninth means for detecting whether or not the audio signal is in a silent state;

tenth means for suspending updating of the address represented by the write address signal when the ninth means detects that the audio signal is in the silent state;

eleventh means for enabling updating of the address represented by the write address signal when the ninth means detects that the audio signal is not in the silent state;

twelfth means for stopping updating of the address represented by the read address signal when the seventh means detects that the address represented by the read address signal overtakes the address represented by the write address signal in cases where the tenth means continuously suspends updating of the address represented by the write address signal; and thirteenth means for continuing stopping of updating of the address represented by the read address signal until the ninth means detects that the audio signal is not in the silent state.

6. An audio signal processing circuit comprising:

a memory having storage segments at different addresses respectively;

first means for generating a write address signal representing an address which is periodically updated at a first frequency;

second means for sequentially writing samples of an audio signal into storage segments of the memory at addresses represented by the write address signal respectively;

third means for generating a read address signal representing an address which is periodically updated at a second frequency lower than the first frequency;

fourth means for sequentially reading out samples of the audio signal from storage segments of the memory at addresses represented by the read address signal respectively;

fifth means for detecting whether or not the audio signal is in a silent state;

sixth means for suspending updating of the address represented by the write address signal when the fifth means detects that the audio signal is in the silent state;

seventh means for enabling updating of the address represented by the write address signal when the fifth means detects that the audio signal is not in the silent state;

eighth means for detecting whether or not the address represented by the read address signal overtakes the address represented by the write address signal;

ninth means for stopping updating of the address represented by the read address signal when the eighth means detects that the address represented by the read address signal overtakes the address represented by the write address signal in cases where the sixth means continuously suspends updating of the address represented by the write address signal; and tenth means for continuing stopping of updating of the address represented by the read address signal until the fifth means detects that the audio signal is not in the silent state.

* * * * *